US005745933A

United States Patent [19]

Yu

[11] Patent Number: 5,745,933

[45] Date of Patent: May 5, 1998

[54] PRE-WASHING DEVICE FOR WATER CIRCULATING TUBE OF MASSAGING BATH TUB

[76] Inventor: Li-Fu Yu, No. 129-9, Lin-Woei Rd., Lin-Meei Tsuen, Jiau-Shi Shiang, Yi-Lan Hsien, Taiwan

[21] Appl. No.: 748,167

[22] Filed: Nov. 12, 1996

[51] Int. Cl.[6] ..... E04H 4/12

[52] U.S. Cl. ..... 4/541.1; 4/541.3; 4/507; 137/607

[58] Field of Search ..... 4/541.1, 541.2, 4/541.3, 541.4, 541.5, 541.6, 507, 509; 137/607

[56] References Cited

U.S. PATENT DOCUMENTS

| | | | |
|---|---|---|---|
| 4,853,987 | 8/1989 | Jaworski | 4/509 |
| 4,856,125 | 8/1989 | Dijkhuizen | 4/541.1 |
| 4,954,179 | 9/1990 | Franninge | 4/541.1 |
| 5,570,481 | 11/1996 | Mathis et al. | 4/541.2 |

FOREIGN PATENT DOCUMENTS

| | | | |
|---|---|---|---|
| 3507472 | 9/1986 | Germany | 4/541.1 |

*Primary Examiner*—Charles R. Eloshway
*Attorney, Agent, or Firm*—Pro-Techtor International

[57] ABSTRACT

A pre-washing device for water circulating tubes of a massaging bath tub includes a cap member for a water circulating tube head, a rotary adjustment block locked with the cap member and formed with opposing wedge-shaped openings, and an inner seat located at the water circulating tube head and having channels for the adjustment block to rotate to two stages. A partitioning plate is disposed in the inner seat and includes wedge-shaped openings corresponding to those of the adjustment block. The adjustment block rotates relative to the inner seat so as to align or offset to control the flow of water from the bath tub into the cap member. A valve body and an independent tube are disposed in the water circulating tube head. The valve body is controlled in cooperation with the opening and closing of the water circulating tube head. That is, when the water circulating tube is closed, the valve body is opened, permitting the water to flow from the independent tube into the water circulating tube for pre-washing.

1 Claim, 9 Drawing Sheets

PRE-WASHING DEVICE FOR WATER CIRCULATING TUBE OF MASSAGING BATH TUB

BACKGROUND OF THE INVENTION

The present invention relates to a pre-washing device for water circulation tubes of a massaging bath tub for washing the tubes before use to remove the dirty water, soap residue, or bacteria accumulated in the water circulating tube so as to ensure the user's hygiene and safety in bathing.

FIG. 1 shows an existing massaging bath tub which includes a water circulating tube set 1 disposed around the main body of the bath tub 2. When water flows into the bath tub 2 to a predetermined level, a pump 12 serves to suck the stored water through a tube head 11 into the water circulating tube set 1. The water is ejected from the tubes at high pressure through the nozzles 13 so as to massage the vital points of a user's body.

After use, when the water contained in the bath tub 2 is drained out, the water contained in the water circulating tube set 1 cannot be drained as well and will accumulate therein. If the user does not use the massaging bath tub frequently, after a period of time, the accumulated water may become a culture bed for various bacteria or bugs. Moreover, various impurities such as soap chips or hairs may also accumulate in the water circulating tube set 1. When the user later uses the massaging bath tub, the contaminated water will be discharged from the water circulating tube set 1 into the bath tub. This leads to hygienic and safety problems. Therefore, it is necessary to eliminate the shortcomings existing in the conventional massaging bath tub.

SUMMARY OF THE INVENTION

It is therefore a primary object of the present invention to provide a pre-washing device for water circulating tubes of a massaging bath tub. The device includes a cap member for a water circulating tube head, a rotary adjustment block locked with the cap member and formed with opposing wedge-shaped openings, and an inner seat located at the water circulating tube head and having channels for the adjustment block to rotate to two stages. A partitioning plate is disposed in the inner seat and includes wedge-shaped openings corresponding to those of the adjustment block. The adjustment block rotates relative to the inner seat so as to align or offset to control the flow of water from the bath tub into the cap member. A valve body and an independent tube are disposed in the water circulating tube head. The valve body is controlled in cooperation with the opening and closing of the water circulating tube head. That is, when the water circulating tube is closed, the valve body is opened, permitting the water to flow from the independent tube into the water circulating tube for pre-washing.

When using the massaging bath tub, a user can rotate and adjust the cap member of the water circulating tube head to offset the wedge-shaped openings of the panel from the wedge-shaped openings of the inner seat. At the same time, the valve body is driven by the adjustment block into an open state, whereby the water can flow from the independent tube into the water circulating tube set. At this time, the pump is activated to pre-wash and clean up the accumulated dirty water in the water circulating tube set. Therefore, before using the bath tub, the user can clean the water circulating tube to ensure hygiene and safety.

The present invention can be best understood through the following description and accompanying drawings.

DETAILED DESCRIPTION OF THE PREFERRED EMBODIMENTS

Figure 1:
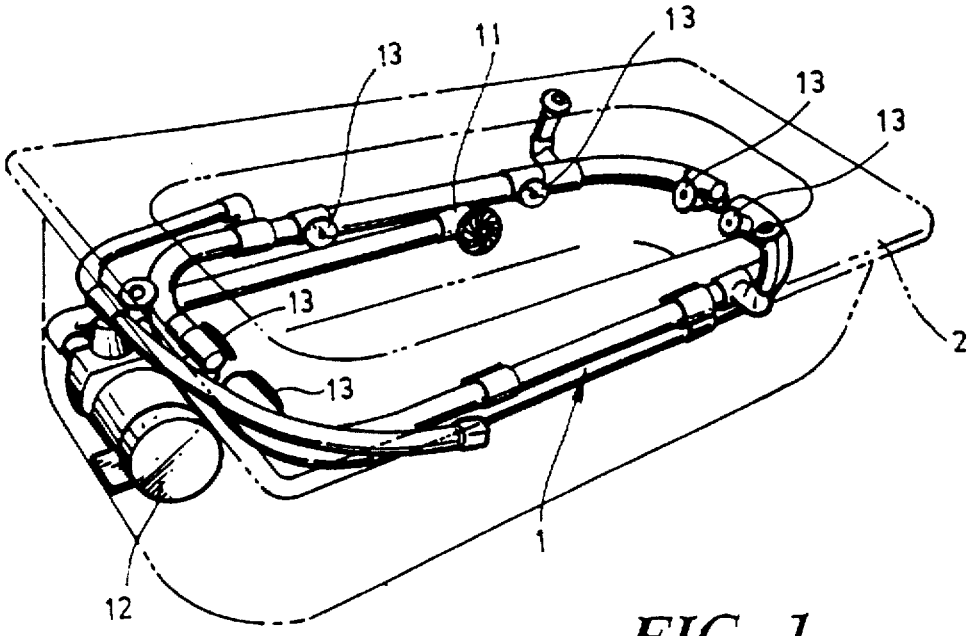
FIG. 1 (PRIOR ART)
FIG. 1 is a perspective view showing the structure of a conventional massaging bath tub.
Figure 2:
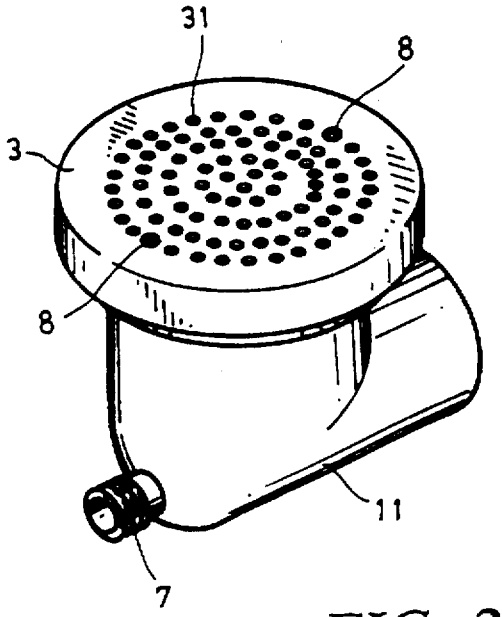
FIG. 2 is a perspective view of the water circulating tube head of the present invention.
Figure 3:
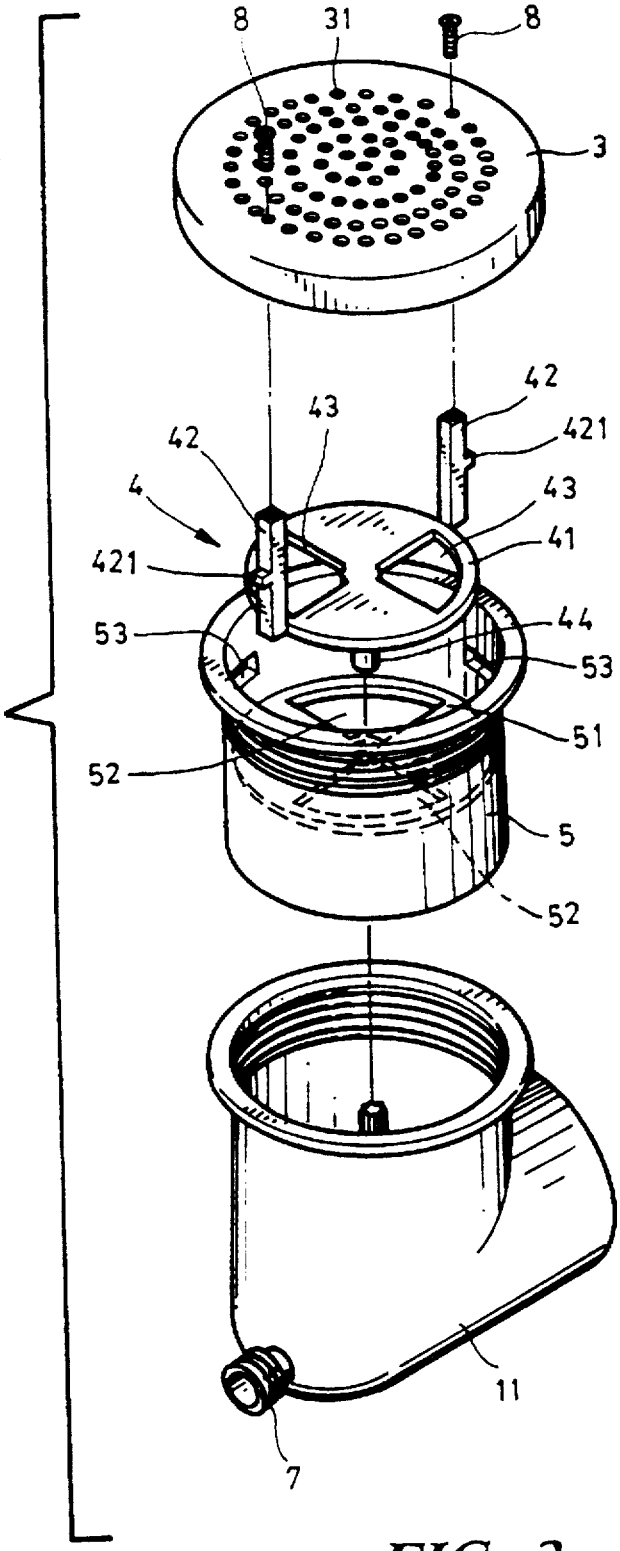
FIG. 3 is a perspective exploded view of the water circulating tube head of the present invention.
Figure 4:
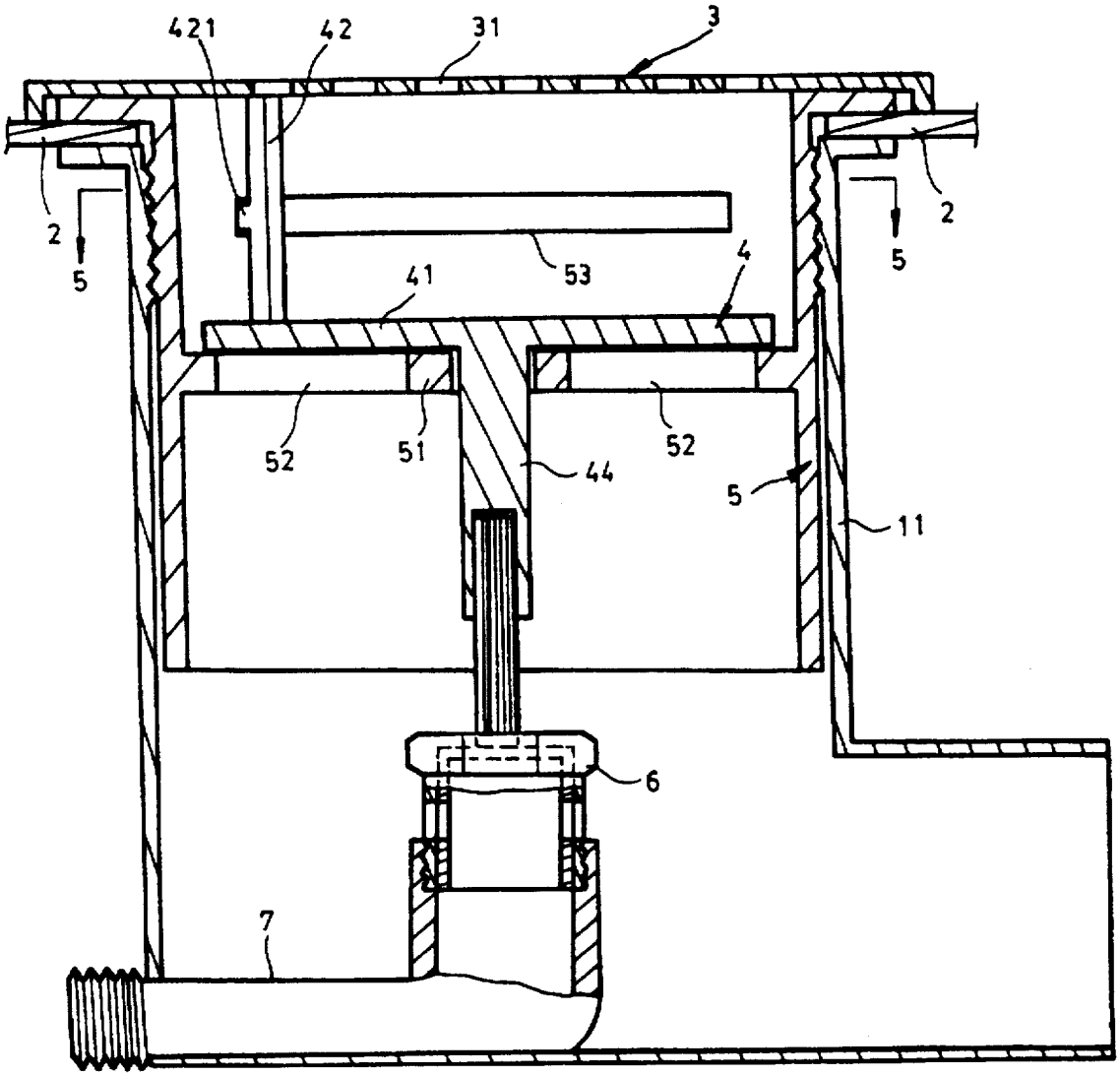
FIG. 4 is a sectional view showing that the water circulating tube head is closed and the valve body is opened.
Figure 5:
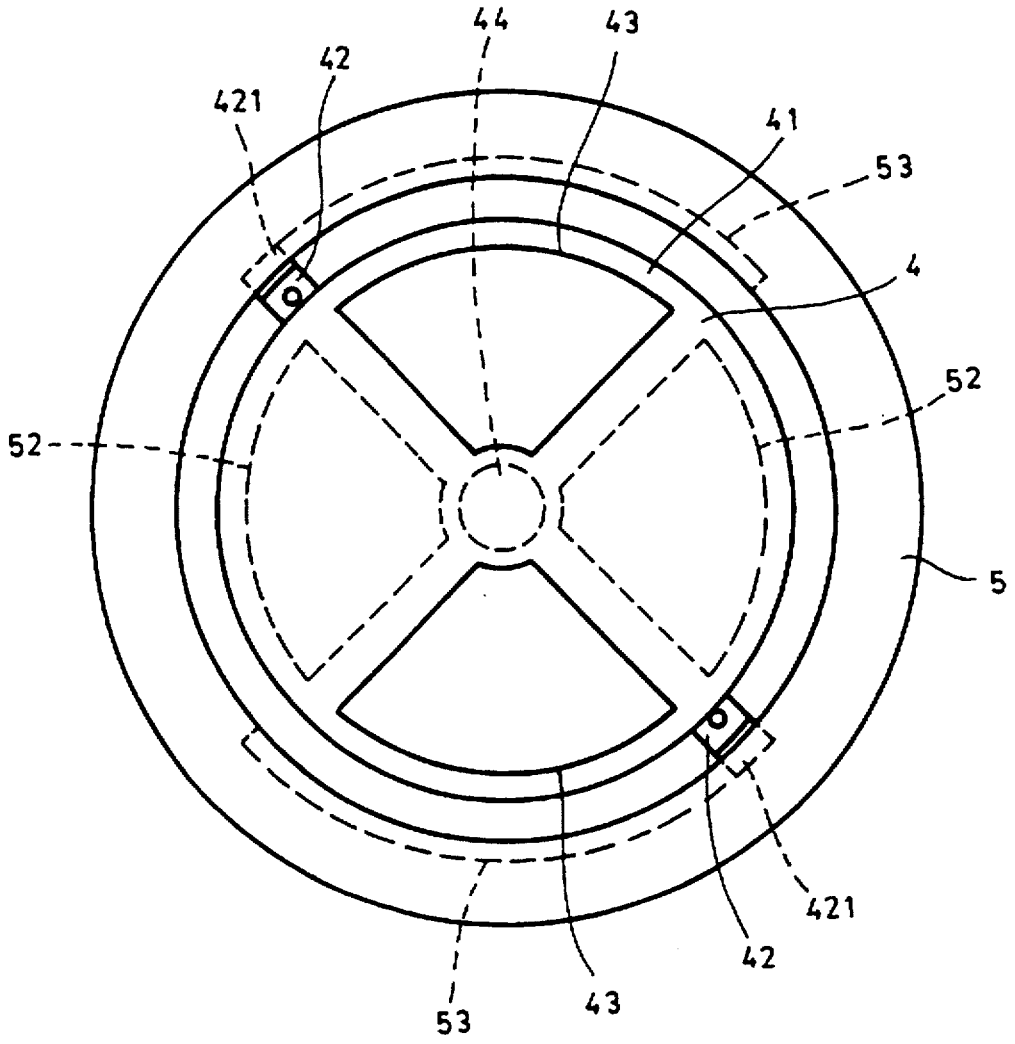
FIG. 5 is a cross-sectional view showing the operation of the adjustment block and inner seat according to FIG. 4.

Please refer to FIGS. 1 to 3. The pre-washing device of the present invention mainly includes a cap member 3 for the water circulating tube head 11, a rotary adjustment block 4, an inner seat 5, a valve body 6 and an independent tube 7 disposed in the water circulating tube head 11. The cap member 3 is formed with multiple water vents 31. The adjustment block 4 includes a circular panel 41 and two posts 42 projecting upward from two sides thereof. The circular panel 41 is formed with two opposing wedge-shaped openings 43. A tenon 421 is formed on an outer side of each post 42. The top ends of the posts 42 are affixed to the cap member 3 by screws 8.

The inner seat 5 is a cylindrical tube body in which the adjustment block 4 is fitted. A partitioning board 51 is disposed at a central section of the inner seat 5. The partitioning board 512 includes two wedge-shaped openings 52 corresponding to the wedge-shaped openings 43 of the panel 41. By rotating the adjustment block 4, the wedge-shaped openings can be aligned or offset.

In addition, the inner wall of the inner seat 5 is formed with two 90 degree channels 53 that receive the tenons 421 of the posts 42, allowing the adjustment block 4 to be adjusted to align or offset the wedge-shaped openings 52, 43 of the partitioning board 51 and the adjustment block 4 from each other and thus control the flow of water from the bath tub 2 into the cap member 3.

A downward extending stem 44 is disposed under the center of the panel 41 of the adjustment block 4 to connect with the valve body 6. The valve body 6 is located at a tube head portion of the independent tube 7 for controlling whether the water therein flows into the water circulating tube set 1.

According to the above arrangement, when a user adjusts the cap member 3 of the water circulating tube head 11, the opening/closing of the water circulating tube head 11 is simultaneously changed. At the same time, the valve body 6 is also controlled in cooperation with the opening/closing of the water circulating tube head 11. FIGS. 4 to 7 show the opening and closing operation of the present invention. First, referring to FIGS. 4 and 5, when the cap member 3 is rotated and closed, the adjustment block is driven to offset the wedge-shaped openings 43 of the panel 41 from the wedge-shaped openings 52 of the inner seat 5. At the same time, the valve body 6 is driven by the adjustment block 4 to an open state, whereby the water flows from the independent tube 7 into the water circulating tube set 1. At this time, the pump 12 (equivalent to that shown in FIG. 1) is activated to flush the accumulated dirty water from the water circulating tube set 1.

Figure 6:
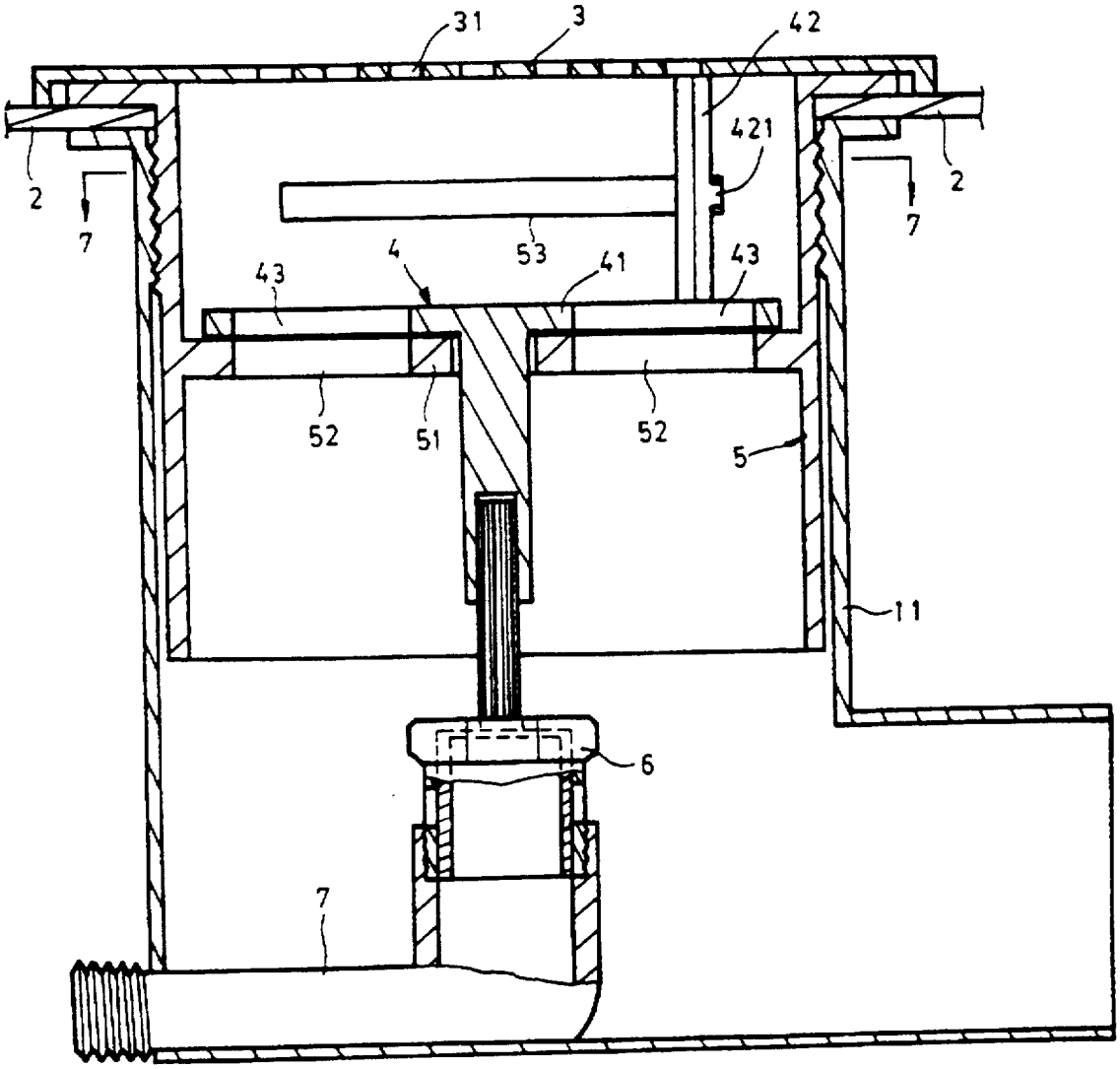
FIG. 6 is a sectional assembled view showing that the water circulating tube head is open and the valve body is closed.
Figure 7:
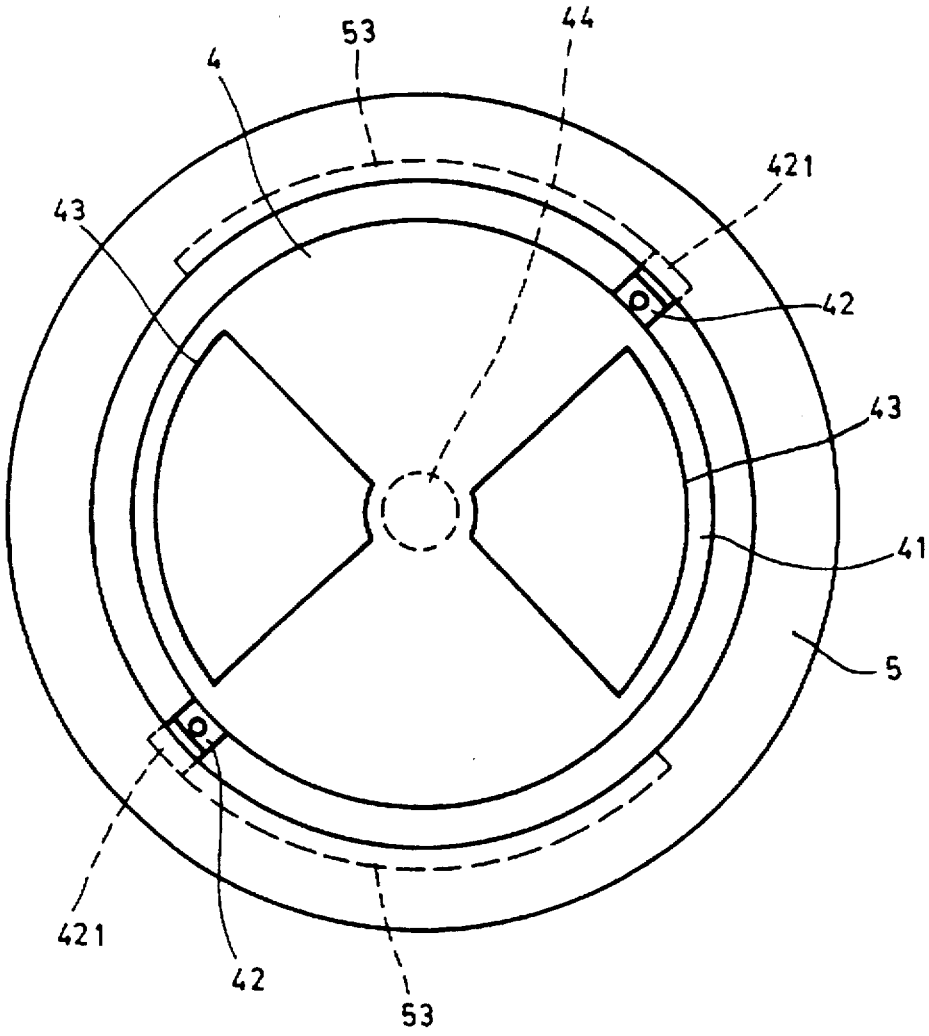
FIG. 7 is a cross-sectional view showing the operation of the adjustment block and inner seat according to FIG. 6.

Referring to FIGS. 6 and 7, after the pre-washing operation is completed, the user can reverse rotate the cap member 3 to align the wedge-shaped openings of the panel 41 with the wedge-shaped openings 52 of the inner seat 5. At this time, the water circulating tube set 1 is in communication with the bath tub 2 to provide a normal water circulating and massaging effect. Also due to the reverse rotation of the adjustment block 4, the valve body 6 is driven to a closed state, whereby the water supply of the independent tube 7 is cut off and the massaging bath tub is restored to normal use.

Figure 8:
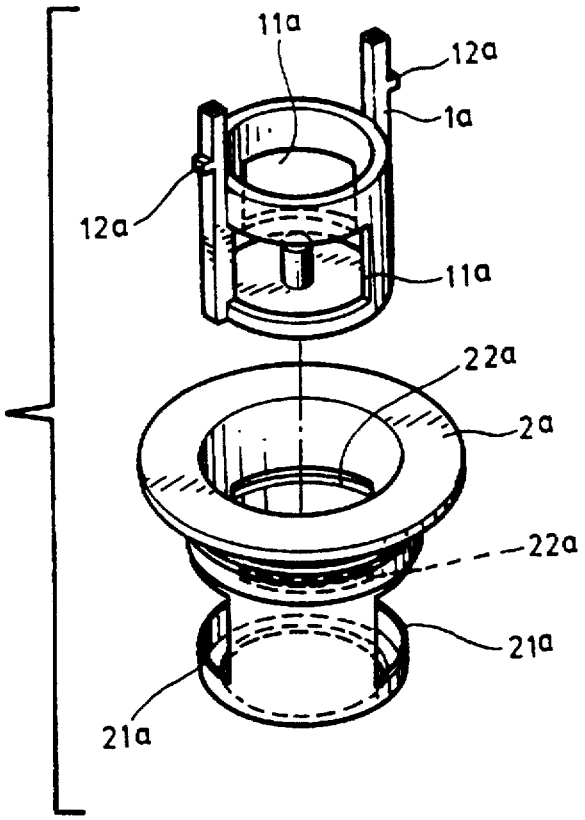
FIG. 8 is a perspective exploded view of the adjustment block and inner seat of another embodiment of the present invention.
Figure 9:
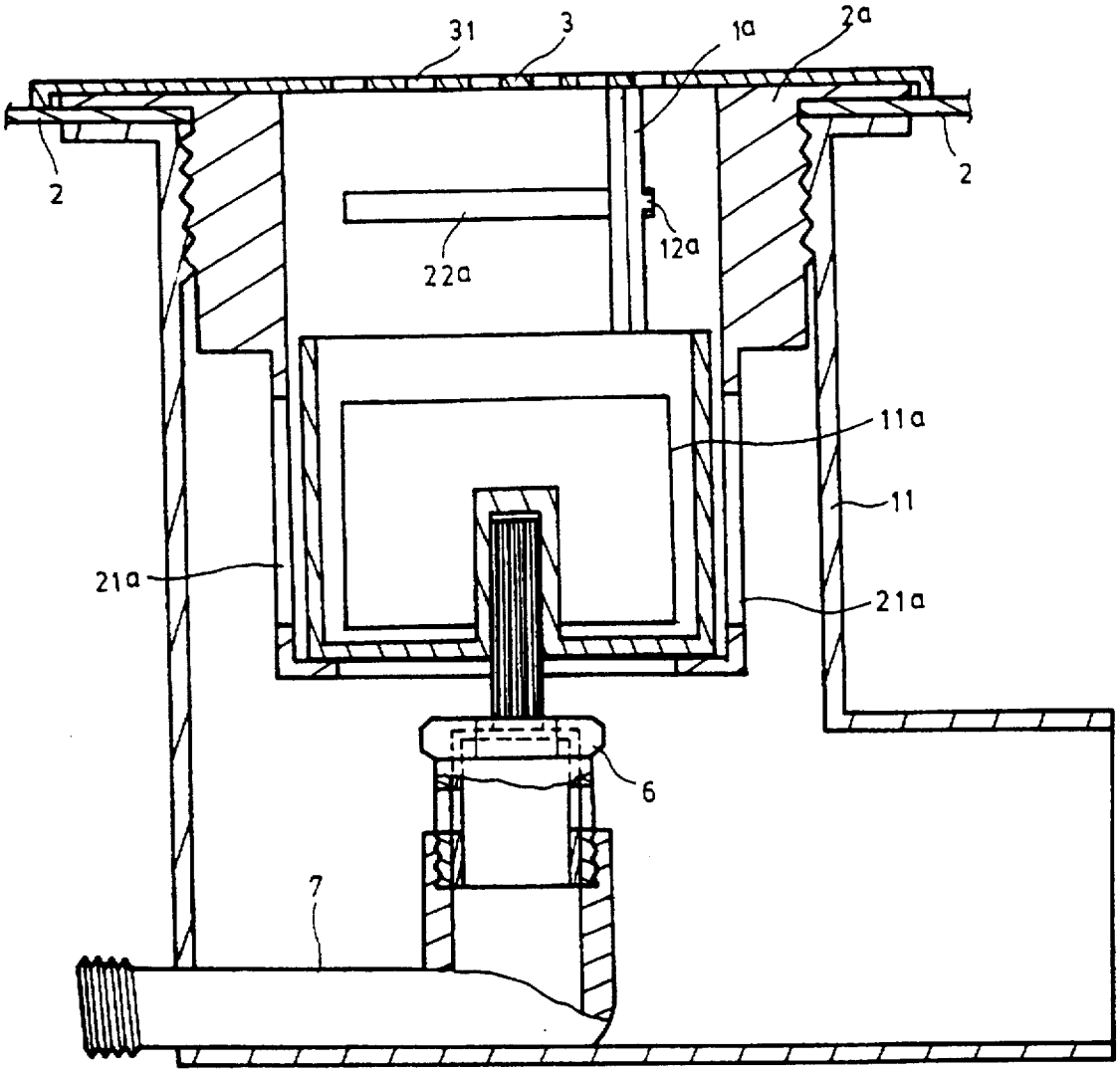
FIG. 9 is a sectional view of the alternate embodiment of the present invention, showing that the water circulating tube head is closed.
Figure 10:
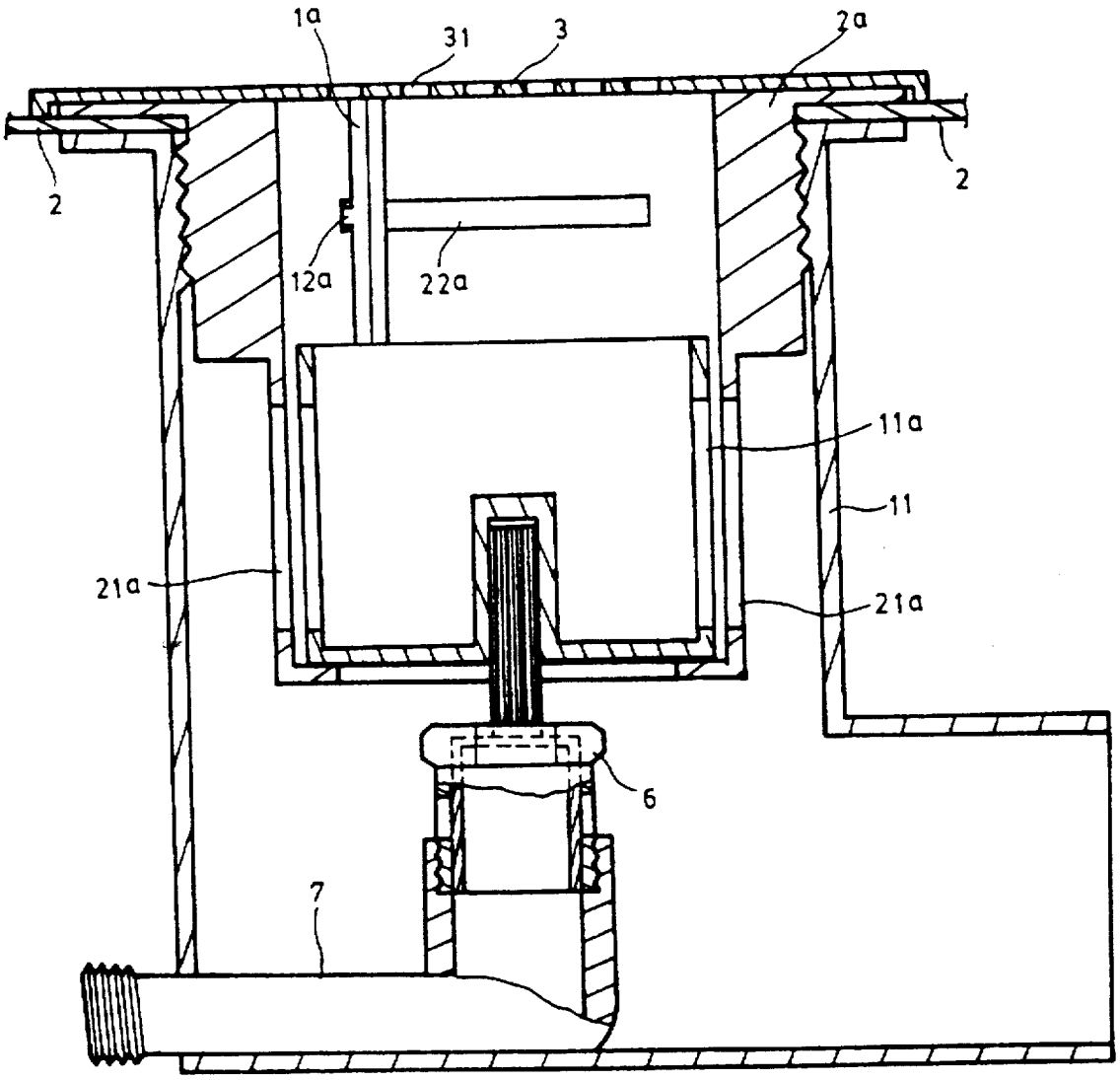
FIG. 10 is a sectional view of the alternate embodiment of the present invention, showing that the water circulating tube head is opened.

FIGS. 8 to 10 show another embodiment of the present invention which is different from the above embodiment in that the openings of the adjustment block 1*a* and the inner seat 2*a* are disposed on the lateral sides thereof. Referring to FIG. 8, the adjustment block 1*a* is tubular, and two opposing openings 11*a* are formed on the sides of the tube wall. The adjustment block 1*a* is fitted into the inner seat 2*a*. The opposite sides of the inner seat 2*a* are formed with openings 21*a* corresponding to the openings 11*a* of the adjustment block 1*a*. When rotating the adjustment block 1*a*, the openings 11*a*, 21*a* can be aligned or offset from each other in an open or closed state two outer sides of the adjustment block 1*a* are disposed with tenons 12*a* corresponding to the channels 22*a* formed on an inner wall of the inner seat 2*a* for two-stage adjustment. The opening/closing operation, as shown in FIGS. 9 and 10, is identical to the first described embodiment and thus will not be further described.

It is to be understood that the above description and drawings are only used for illustrating preferred embodiments of the present invention, and are not intended to limit the scope thereof. Any variation and derivation from the above description and drawings should be included in the scope of the present invention.

I claim:

1. A pre-washing device for water circulating tubes of a massaging bath tub comprising:

a cap member received in a water circulating tube head, a rotary adjustment block, an inner seat, a valve body and an independent tube disposed in the water circulating tube head;

wherein said cap member includes a plurality of water vents, said adjustment block includes two posts projecting upward therefrom, said adjustment block is tubular with at least one opening in a side thereof to allow water to flow therethrough, said posts each include a tenon formed on a side thereof, top ends of said posts are secured to said cap member, said inner seat is a cylindrical body that receives said adjustment block, said inner seat includes channels to receive said tenons of said posts, said inner seat includes at least one opening in a side thereof to allow water to flow therethrough, said at least one opening in said side opening of said inner seat corresponds with said at least one opening in said adjustment block; such that when said adjustment block is rotated, said openings in said adjustment block and said side of said inner seat are aligned and offset to open and close to control water flow through said device, a downward extending stem being connected to an underside of said adjustment block, said stem controls opening and closing of said valve body in conjunction with rotation of said cap member such that when said cap member is rotated to align said openings, said valve body is closed, and when said cap member is rotated to offset said openings, said valve body is opened.

* * * * *